US010329853B2

(12) United States Patent
Duhon et al.

(10) Patent No.: US 10,329,853 B2
(45) Date of Patent: Jun. 25, 2019

(54) MOTION COMPENSATOR SYSTEM AND METHOD

(71) Applicant: ADVANCED TOOL & SUPPLY, LLC, Broussard, LA (US)

(72) Inventors: Bryan Duhon, Church Point, LA (US); Yury Remedio, Lafayette, LA (US)

( * ) Notice: Subject to any disclaimer, the term of this patent is extended or adjusted under 35 U.S.C. 154(b) by 0 days.

(21) Appl. No.: 15/918,700

(22) Filed: Mar. 12, 2018

(65) Prior Publication Data

US 2018/0258712 A1 Sep. 13, 2018

Related U.S. Application Data

(60) Provisional application No. 62/469,743, filed on Mar. 10, 2017.

(51) Int. Cl.
*E21B 19/00* (2006.01)

(52) U.S. Cl.
CPC ..... *E21B 19/006* (2013.01)

(58) Field of Classification Search
CPC ..... E21B 19/006; E21B 19/09
See application file for complete search history.

(56) References Cited

U.S. PATENT DOCUMENTS 4,004,532 A * 1/1977 Reynolds ..... E21B 19/006 114/256
6,929,071 B2 8/2005 Moncus
7,163,061 B2 1/2007 Moncus et al.
7,191,837 B2 * 3/2007 Coles ..... E21B 19/09 166/350
8,672,039 B2 3/2014 Miller, III et al.
2008/0099208 A1 5/2008 Moncus et al.
2016/0145952 A1 * 5/2016 Hafernik ..... F15B 1/04 166/355
2016/0237766 A1 * 8/2016 Zeng ..... E21B 19/006

* cited by examiner

*Primary Examiner* — James G Sayre
(74) *Attorney, Agent, or Firm* — Jones Walker LLP

(57) ABSTRACT

A motion compensator system for use on a floating vessel including a compensator cylinder assembly, a guide cylinder assembly, an upper carriage affixed to an upper end of both cylinder assemblies, a lower carriage affixed to a lower end of both cylinder assemblies, and a safety shutoff assembly. The compensator cylinder assembly includes three or more compensator cylinders. The safety shutoff assembly includes a compensator manifold and three or more compensator valves. Each compensator valve is in fluid communication with a pressurized fluid source through the compensator manifold and in fluid communication with a lower chamber of one of the compensator cylinders. The safety shutoff assembly is configured to isolate a failed compensator cylinder by setting the associated compensator valve to a vent setting and continuing normal operation of the remaining compensator cylinders. The motion compensator system optionally includes a lock system for securing the system in a retracted position.

20 Claims, 16 Drawing Sheets

MOTION COMPENSATOR SYSTEM AND METHOD

CROSS-REFERENCE TO RELATED APPLICATION

This application claims the benefit of and priority to U.S. Provisional Patent Application No. 62/469,743 filed on Mar. 10, 2017, which is incorporated herein by reference in its entirety.

DETAILED DESCRIPTION OF THE PREFERRED EMBODIMENT

Motion compensators are used on offshore drilling platforms to compensate for the wave action which results in vertical displacement of the drilling platform deck. Prior art motion compensators are described in U.S. Pat. No. 7,191,837, issued on Mar. 20, 2007, to Coles, which is incorporated herein by reference, and U.S. Pat. No. 6,929,071, issued on Aug. 16, 2005, to Moncus et al., which is incorporated herein by reference. A novel compensator system and method of use is disclosed herein. The compensator system includes: (i) the compensator, (ii) the carriage components that retain the compensator, (iii) a safety shut off system, and (iv) a locking mechanism. The carriage components assist in mounting the compensator to a derrick or crane. The carriage components also assist in mounting a load, such as a drill string or lift frame, to the compensator. The safety shut off system is configured to monitor the cylinders in the inner cylinder assembly. If one or more of these cylinders fails, the safety shut off system isolates the failed cylinder(s) so that operations can continue and distribute the load on the remaining operable cylinders until repair operations can be implemented. This prevents the compensator from failing. A failure in the compensator could result in the load being dropped, damaging both equipment and people who may be in the area. Additionally, the compensator system includes a locking mechanism which functions to lock the compensator system in a retracted position. The compensator system described herein is capable of supporting a load of up to 750 tons.

Figure 1:
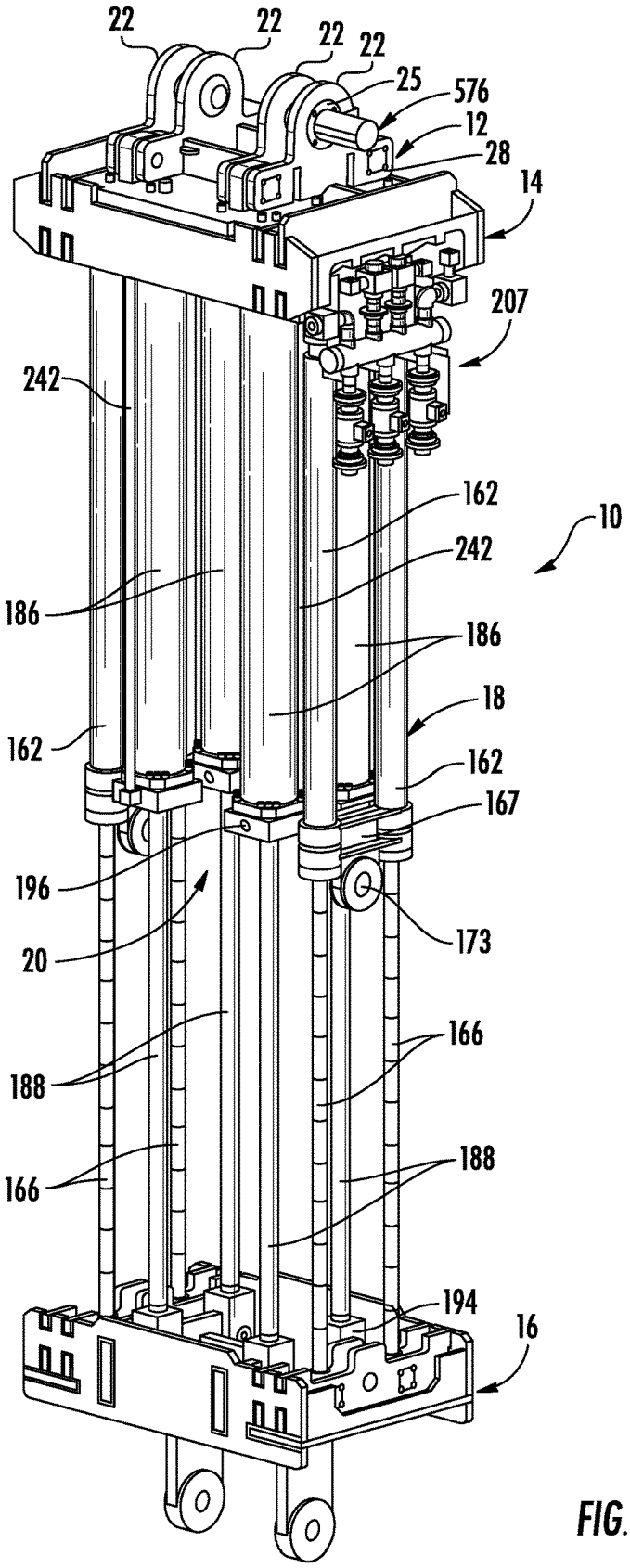
FIG. 1 is a perspective view of a compensator system in an extended position.

FIG. 1 illustrates one embodiment of the compensator system. Compensator system 10 includes an upper compensator carriage 12, a cylinder carriage 14, a lower compensator carriage 16, an outer guide cylinder assembly 18, and an inner compensator cylinder assembly 20. The upper compensator carriage 12 is connected to the cylinder carriage 14. Cylinder carriage 14 and lower compensator carriage 16 are configured to retain the outer cylinder assembly 18 and the inner cylinder assembly 20 in the compensator system 10. Upper compensator carriage 12 is configured to be mounted to a derrick or crane. Lower compensator carriage 16 is configured to suspend a load, such as a drill string, to the compensator system. The compensator system 10 is configured to operate in a fully extended position shown in FIG. 1, a fully retracted position shown in FIG. 2, or any position therebetween. The operational position of the compensator system 10, whether extended, retracted, or in an intermediate position, will be determined by the height of the deck from the seabed. The height of the deck from the seabed is determined by the water surface, which is subject to change due to wave action and/or tidal phases.

The upper compensator carriage 12 is configured to mount the compensator system 10 to a derrick or crane. The upper compensator carriage 12 includes lift eyes 22 each having central aperture 25 and side apertures 28. Central aperture 25 is dimensioned to receive a fastener to attach the upper compensator carriage 12 to a derrick or crane.

Figure 3:
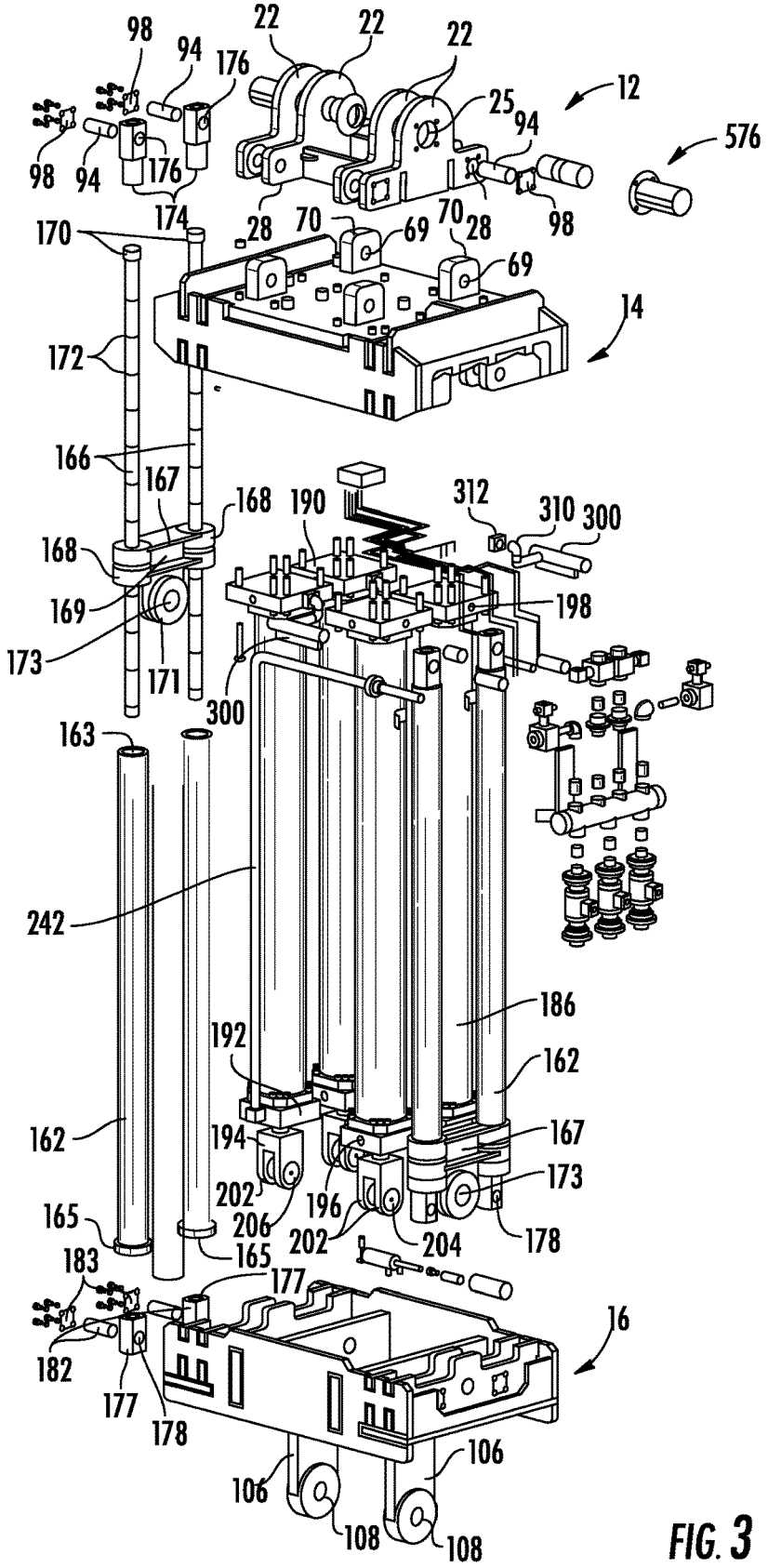
FIG. 3 is an exploded view of the various components of the compensator system.

The cylinder carriage 14 attaches to the upper compensator carriage 12 and retains the upper end of both the outer guide cylinder assembly 18 and the inner compensator cylinder assembly 20. As shown in FIG. 3, the upper end of the cylinder carriage 14 includes mounting members 69. In one embodiment, cylinder carriage 14 may include four mounting members 69. Each mounting member 69 includes aperture 70. Mounting members 69 connect the cylinder carriage 14 to the upper compensator carriage 12. Mounting members 69 are positioned to align with the spaces between lift eyes 22 of the upper compensator carriage 12 so that apertures 70 in mounting member 69 align with central apertures 25 of the lift eyes 22. Upper compensator carriage 12 and cylinder carriage 14 together form an upper carriage for the compensator system 10.

Referring to FIG. 3, in one embodiment, a pin 94 is secured through side apertures 28 of each set of adjacent lift eyes 22 and aperture 70 of the corresponding mounting member 69 disposed between the adjacent lift eyes 22. Each pin 94 may be locked in apertures 28 and 70 by affixing a mounting plate 98 over aperture 28 of the outer lift eye 22. In this way, pins 94 connect the cylinder carriage 14 to the upper compensator carriage 12.

With reference to FIG. 3, the lower compensator carriage 16 is configured to secure a load, such as a drill string, to the compensator system 10. Lower compensator carriage 16 is also configured to retain the lower ends of outer guide cylinder assembly 18 and inner compensator cylinder assembly 20 (as described in more detail below). In the embodiment illustrated, lower compensator carriage 16 includes two mounting brackets 106 extending below from the remainder of lower compensator carriage 16. Each mounting bracket 106 includes a mounting aperture 108 configured to receive a fastener, such as a pin, screw, bolt, rope, hoist, hook, or any other suitable fastener for attaching a load to the compensator system 10. Mounting brackets 106 are centrally positioned in lower compensator carriage 16 such that when a load is mounted to mounting brackets 106, the weight of the load is evenly distributed through the compensator system 10. Each mounting bracket 106 also includes a locking pin aperture configured to receive part of a locking assembly (described in more detail below) and cylinder apertures configured to receive a fastener to connect the inner compensator cylinder assembly 20 and outer guide cylinder assembly 18 to the lower compensator carriage 16.

Outer guide cylinder assembly 18 is connected to cylinder carriage 14 and lower compensator carriage 16. The outer guide cylinder assembly 18 includes cylinders 162. Cylinders 162 have an inner bore 163 defined by an inner bore wall. Cylinder 162 also has an enlarged external diameter 165 located at the lower end of cylinder 162. The outer cylinder assembly 18 may include four cylinders 162, with a pair of cylinders 162 located on either side of inner compensator cylinder assembly 20. Outer cylinder assembly 18 also includes guide rods 166 and brackets 167. Each bracket 167 is secured to a pair of adjacent cylinders 162. Bracket 167 includes paired bracket mounts 168 for mounting the bracket 167 to cylinders 162. Central portion 169 of bracket 167 interconnects bracket mounts 168. Central portion 169 includes lower projection 171 having aperture 173, which is disposed below bracket mounts 168. Aperture 173 forms a through bore for locking the outer cylinder assembly 18 in a retracted position. Aperture 173 is dimensioned to receive a locking system (described below). Bracket 167 is positioned on the lower end of cylinder 162 and is retained on cylinder 162 by the enlarged diameter bottom portion of cylinder 162.

Guide rod 166 is slidingly disposed in the inner bore 163 of cylinder 162. Guide rod 166 includes an enlarged diameter upper portion 170 and length designations 172 along the length of guide rod 166. Guide rods 166 are of a smaller diameter than the inner bore 163 of cylinder 162 and are allowed to freely slide vertically along the length of cylinder 162. The upper end of cylinder 162 is closed. The lower end of cylinder 162 has an internal collar that reduces the diameter of the inner bore 163 at the bottom of cylinder 162. Enlarged diameter upper portions 170 of guide rods 166 have a diameter that is greater than that of the remaining length of guide rods 166. The diameter of enlarged diameter upper portion 170 is also greater than the diameter of the opening formed by the internal collar at the bottom of cylinder 162, thereby retaining guide rods 166 in cylinders 162. Length designations 172 provide an indication of the length of guide rod 166 extended below the bottom of cylinder 164. In one embodiment, length designations 172 are numbers that correspond to the approximate number of feet of guide rod 166 that is extended below the bottom of cylinder 162. In another embodiment, the length designations 172 are horizontal lines that represent a specific distance, such as each line representing a foot or meter. Cylinder 162 includes a mounting member 174 at the upper end. The mounting member 174 includes aperture 176. Aperture 176 is dimensioned to receive a fastener to connect cylinder 162 to cylinder carriage 14. Aperture 176 aligns with apertures of the cylinder carriage 14. For example, the mounting member 174 of each cylinder 162 may fit between the two brackets of the cylinder carriage 14 to align aperture 176 of the cylinder 162 with apertures in each bracket. A fastener may then be secured through aperture 176 of each cylinder 162 and apertures in the brackets of the cylinder carriage 14 in order to secure each cylinder 162 of outer guide cylinder assembly 18 to cylinder carriage 14.

Each guide rod 166 includes a mounting member 177 located on the bottom of guide rod 166. Apertures 178 are located in mounting member 177 and are dimensioned to receive a fastener, such as a pin, bolt, or screw, to connect a lower end of each guide rod 166 to the lower compensator carriage 16. For example, the mounting member 177 of each guide rod 166 may fit between the two brackets of the lower compensator carriage 16 to align aperture 178 of the guide rod 166 with apertures in each bracket. Additionally, when the guide rods 166 are in the retracted position shown in FIG. 2, aperture 173 of bracket 167 may be disposed between two brackets of the lower compensator carriage 16, thereby aligning aperture 173 with the apertures in the brackets. In this position, the locking system (described below) is capable of engaging the aperture 173 and the apertures of the brackets to lock the compensator system 10 in the retracted position.

Referring to FIG. 3, fasteners, such as pins 182, may be secured through apertures 178 of the mounting members 177 and the apertures in the brackets of lower compensator carriage 16. Pins 182 may be locked in the apertures by affixing mounting plates 183 over the apertures in the brackets. In this way, pins 182 connect the lower compensator carriage 16 to outer guide cylinder assembly 18.

With reference still to FIG. 3, inner compensator cylinder assembly 20 is also connected to the cylinder carriage 14 and the lower compensator carriage 16. The inner cylinder assembly 20 includes cylinders 186, compensator rods 188, top plate 190, bottom plate 192, mounting brackets 194, bottom plate apertures 196, top plate apertures 198, mounting bracket arms 202, mounting arm apertures 204, and fasteners 206. In the embodiment illustrated, inner compensator cylinder assembly 20 includes four cylinders 186. Cylinders 186 are hollow cylinders each housing a piston and partially housing a compensator rod 188. A top plate 190 is positioned at the upper end of each cylinder 186 and a bottom plate 192 is located at the bottom end of each cylinder 186. Inner compensator cylinder assembly 20 may be mounted to the cylinder carriage 14 with fasteners, such as pins, screws, or bolts, disposed through apertures in the top plate 190 and through apertures in a plate of the cylinder carriage 14. Bottom plate 192 includes an aperture (not shown) and compensator rod 188 is slidingly disposed through this aperture. Compensator rods 188 have a smaller diameter than the hollow portion of cylinder 186 and are allowed to slide vertically along the length of cylinder 186. Compensator rods 188 have an enlarged diameter section or piston (not shown) at its upper end that prevents compensator rod 188 from falling out of cylinder 186. The piston of compensator rod 188 is larger in diameter than the aperture through bottom plate 192, thereby retaining compensator rod 188 in cylinder 186. The piston also creates an upper chamber and a lower chamber within the hollow portion of cylinder 186. Bottom plate 192 includes at least one bottom member aperture 196, which provides a fluid inlet to the lower chamber for a pressurized fluid. The pressure applied by the fluid in the lower chambers controls the position of the pistons and compensator rods 188 in cylinders 186. The top plate apertures 198 fluidly connect the upper chambers of cylinders 186 to a filter manifold 300.

Mounting brackets 194 are located at the bottom ends of compensator rods 188. Each mounting bracket 194 includes at least two spaced-apart bracket arms 202, with each bracket arm 202 including an arm aperture 204. The bracket arms 202 are substantially parallel to one another with the arm apertures 204 substantially aligned. Compensator rods 188 are secured to lower compensator carriage 16 by sliding a bracket of lower compensator carriage 16 between bracket arms 202 of a mounting bracket 194. Fastener 206 may then be secured through arm apertures 204 of compensator rods 188 and through apertures in the bracket of lower compensator carriage 16. Fastener 206 may be any fastener known in the art, such as screws, bolts, pins, and the like.

In operation, compensator system 10 is retracted by flowing a pressurized fluid through bottom plate apertures 196 and into the lower chambers of cylinders 186 of inner compensator cylinder assembly. The increased pressure in the lower chambers forces the pistons at the upper ends of each compensator rod 188 upward within the cylinder 186, which pulls the compensator rod 188 into cylinder 186 (upward direction). Conversely, compensator system 10 is extended by venting the pressurized fluid from the lower chambers of cylinders 186 through bottom plate apertures 196 (e.g., to the atmosphere or to an accumulator). In this position, the effect of gravity on a tool suspended below compensator system 10 pulls the pistons at the upper ends of each compensator rod 188 downward within the cylinder 186, thereby pulling the compensator rod 188 outward from cylinder 186 (downward direction). As compensator rods 188 of the inner compensator cylinder assembly 20 extend from or retract into cylinders 186, guide rods 166 of the outer guide cylinder assembly 18 will also extend from or retract into cylinders 162 to the same degree. The amount of movement may be determined by viewing length designations 172 on guide rods 166. In one embodiment, the length designations 172 are numbers representing approximately one-foot intervals. In one embodiment, the enlarged diameter upper portion 170 on guide rods 166 reach the end of cylinder 162 approximately 3 inches before compensator rods 188 reach the end of cylinders 186.

Figure 4:
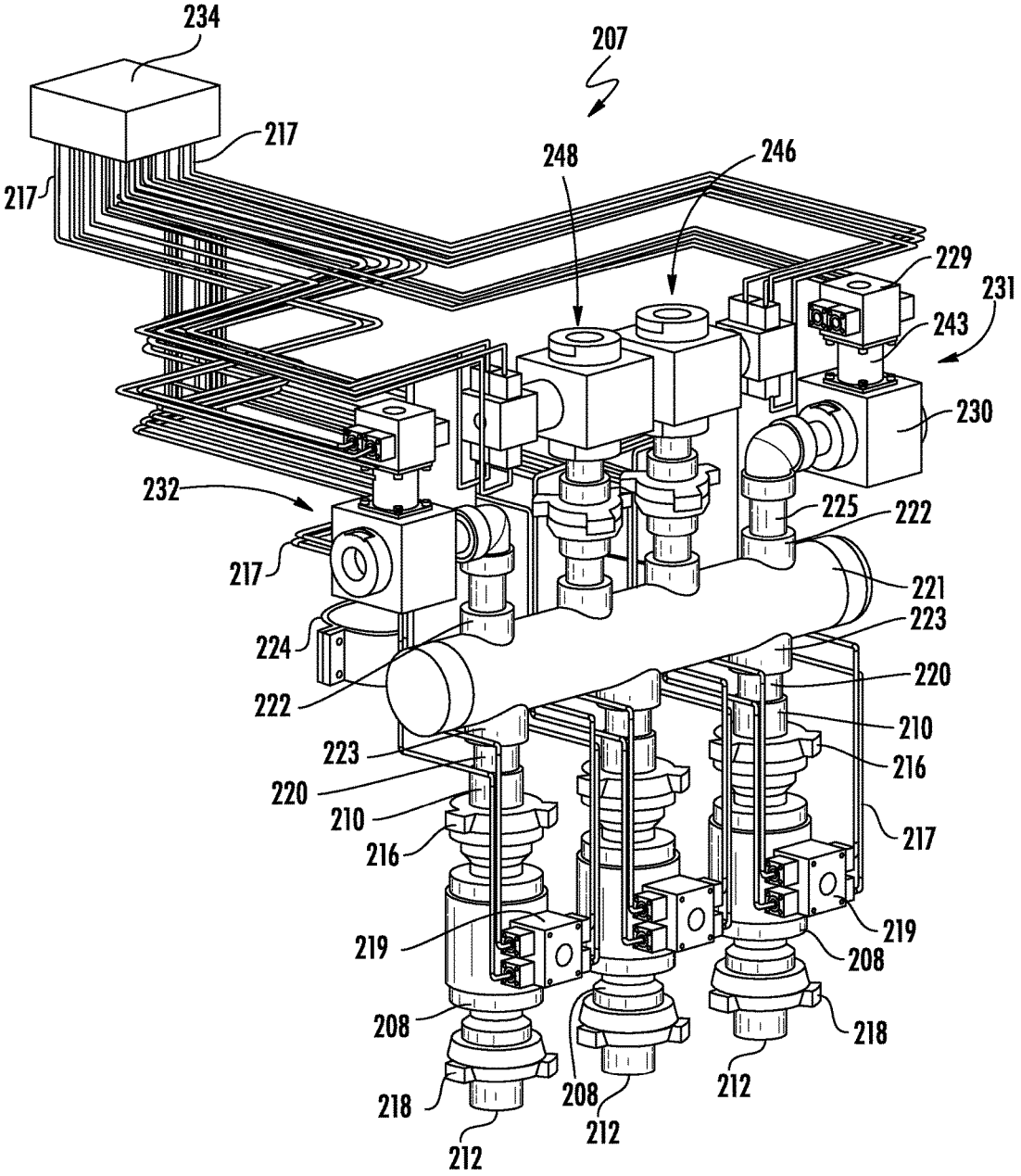
FIG. 4 is a perspective view of a safety shutoff system of the compensator system.

With reference now to FIG. 4, compensator system 10 further includes a safety shutoff assembly 207, which connects a tank assembly containing a pressurized gas to the lower chambers of cylinders 186 in the inner compensator cylinder assembly 20. The safety shutoff system 207 includes numerous valves and actuators. For example, safety shut off system 207 may include valves 208, each having a valve outlet 210 and a valve inlet 212, upper hammer union 216, connections 217, lower hammer union 218, and actuator 219. In one embodiment, safety shutoff system 207 includes three valves 208. Valves 208 may be piston operated ball valves. Valve inlets 212 and valve outlets 210 may each be connected to valves 208 with lower hammer unions 218 and upper hammer unions 216, respectively. Each valve 208 may be fluidly connected to the tank assembly (described below) through valve inlet 212. Each valve 208 may be fluidly connected to compensator manifold 221 through valve outlet 210 and one of the connector pipes 220. Each valve 208 may be connected to one of the pipes 220 through the upper hammer union 216. Compensator manifold 221 includes outlets 222 and inlets 223. In the illustrated embodiment, compensator manifold 221 includes three inlets 223 and four outlets 222. Each pipe 220 is connected to one of the inlets 223. The compensator manifold 221 also has a mounting bracket 224 for connecting the compensator manifold 221 to the upper end of two cylinders 162 on one side of the outer guide cylinder assembly 18 via fasteners, such as screws and washers.

Cylinders 186 of the inner compensator cylinder assembly 20 are fluidly connected to the compensator manifold 221 through actuator assemblies 231, 232, 246, and 248. Each actuator assembly is associated with one of the cylinders 186. Pipes 225 connect the outlets 222 of compensator manifold 221 to the actuator assemblies for each cylinder 186. Hammer unions may be used to connect certain actuator assemblies to the compensator manifold 221. For example, first actuator assembly 231 and second actuator assembly 232 are connected to the compensator manifold via pipe 225 and an elbow joint, while third actuator assembly 246 and fourth actuator assembly 248 are each connected to the compensator manifold 221 via pipes connected with a hammer union.

Actuator assemblies 231, 232, 246, and 248 each include an actuator 229 and a compensator valve 230 connected by mounting member 243. Each compensator valve 230 includes three fluid ports. One fluid port leads to outlet 222 of compensator manifold 221, another fluid port leads to the associated cylinder 186, and the third fluid port is a vent leading to the atmosphere. In one embodiment, each compensator valve 230 is a 3-way ball valve. In another embodiment, each compensator valve 230 is a piston operated 3-way ball valve.

Figure 2:
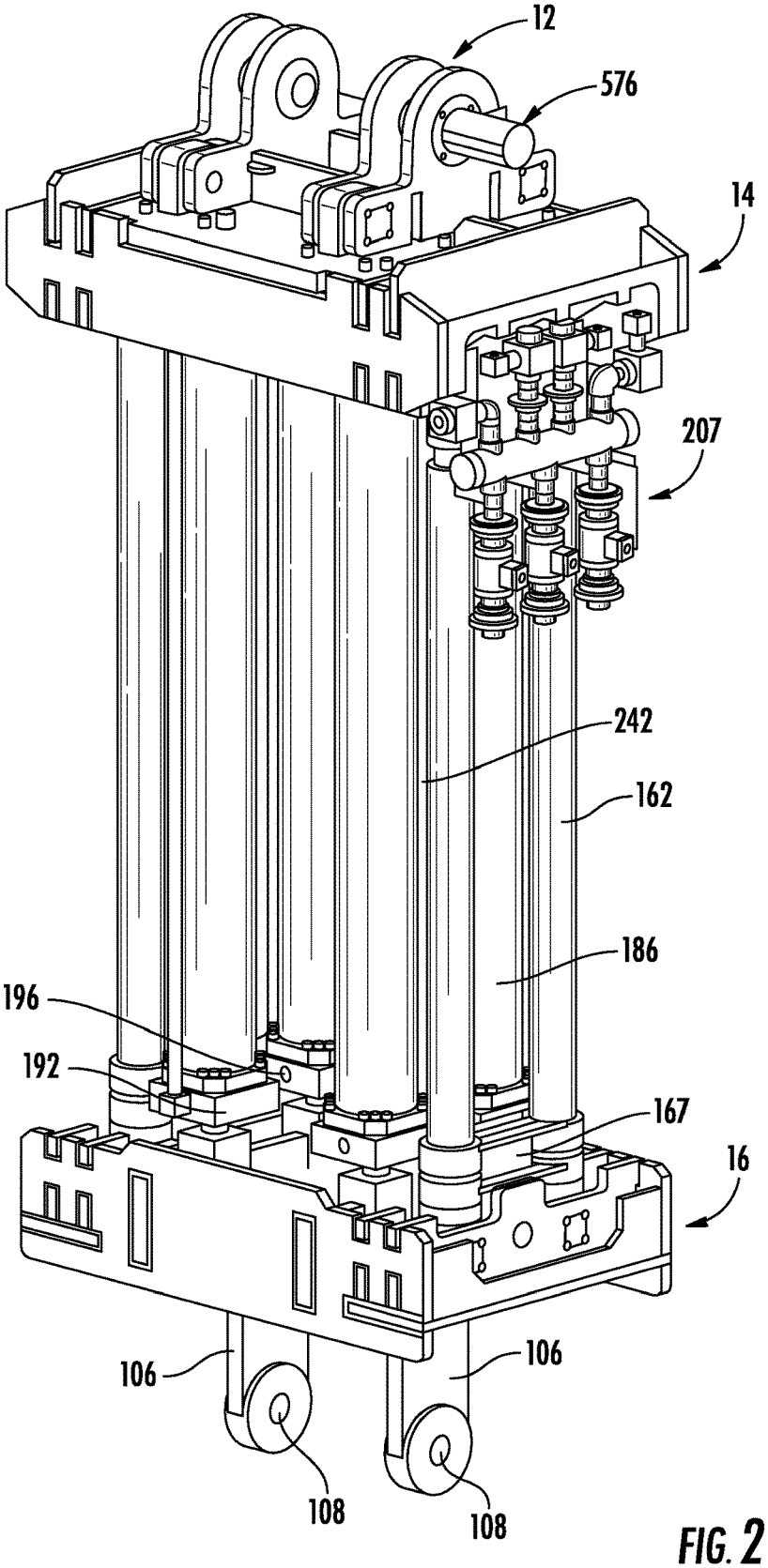
FIG. 2 is a perspective view of the compensator system in a retracted position.

Referring to FIGS. 1-3, the compensator valves 230 are connected to cylinders 186 through pipe 242 (shown in FIGS. 1 and 3). Each pipe 242 is fluidly connected to a fluid port of one of the compensator valves 230 and to the bottom plate apertures 196 of the cylinders 186 via a connecting member. Pipe 242 may be made up of more than one pipe member. Additionally, the pipe members of 242 may be connected to one another with hammer unions. Each actuator assembly 231, 232, 246, of 248 and its associated compensator valve 230 is operatively connected to only one cylinder 186 and therefore controls the flow of fluid to and from the cylinder 186 with which it is fluidly connected.

With reference again to FIG. 4, safety shutoff assembly 207 further includes control block 234, which is connected to each of the valves 208 and 230 through actuators 219 and 229, respectively, via the connections 217. Connections 217 may be electrical, pneumatic, or hydraulic connections. In one embodiment, the actuators 219 and 229 are pneumatic. In operation, control block 234 controls the setting of each valve 208 and 230 by transmitting signals to actuators 219 and 229, respectively. The setting signal transmitted by control block 234 may cause actuators 219 and 229 to open and/or close one or more fluid ports in valves 208 and 230, respectively. The setting transmitted by control block 234 may be in response to a manual input from a user. Alternatively, the setting transmitted by control block 234 may be automatically generated in response to a predefined condition detected by one or more meters or other devices in communication with control block 234. If one or more of cylinders 186 fail, control block 234 activates the appropriate actuator assembly 231, 232, 246, and 248 in order to change the operative configuration of compensator valve 230 and isolate the failed cylinder 186. In this way, the safety shutoff assembly 207 allows continued operation of the compensator system 10 even when one of the cylinders 186 fails.

Figure 5:
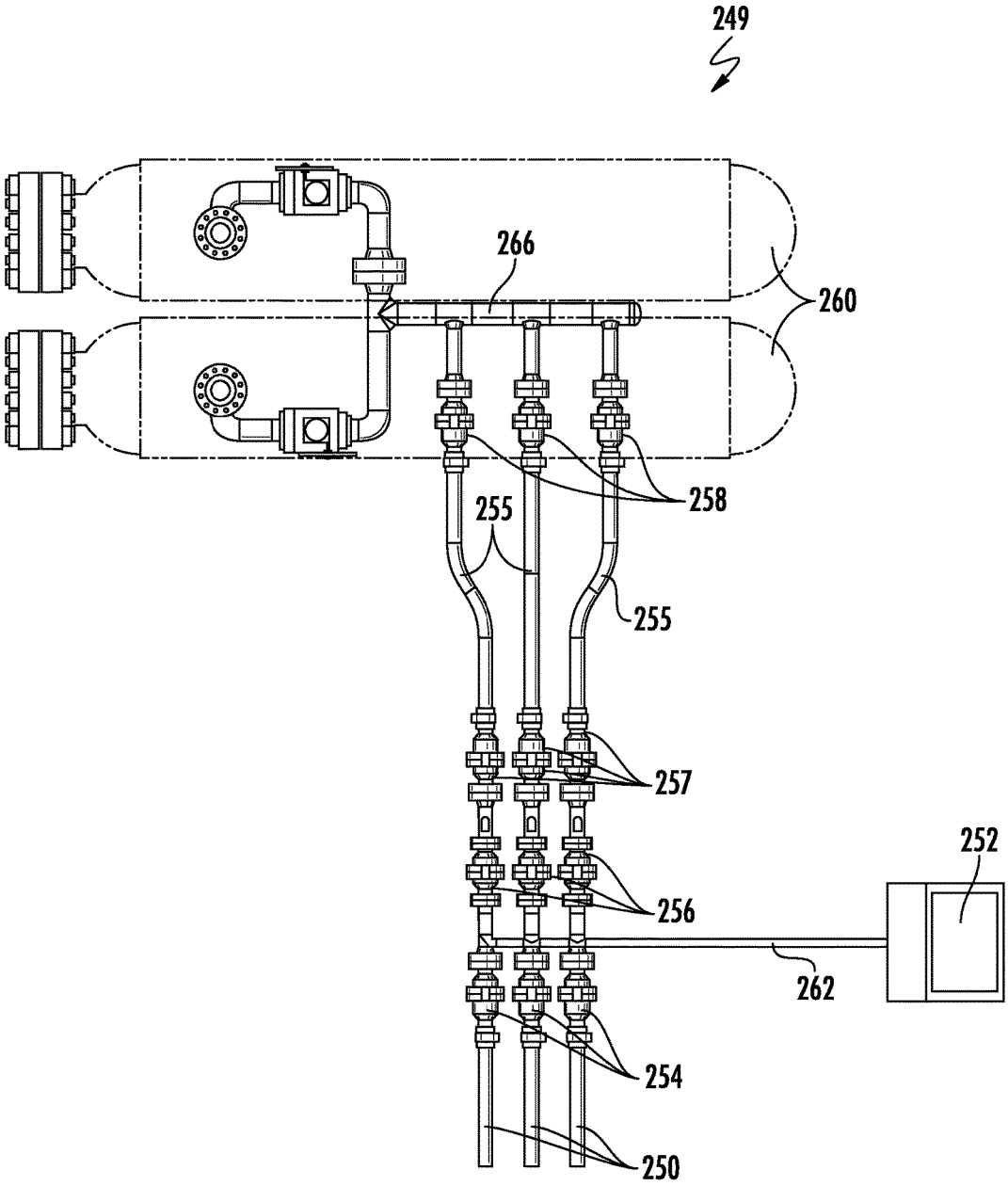
FIG. 5 is a schematic view of a tank assembly of the compensator system.

With reference to FIG. 5, tank assembly 249 of compensator system 10 may be located on the deck of the platform or rig. The tank assembly 249 is a pressurized fluid source; it supplies pressurized fluid to the lower chambers of cylinders 186 through safety shut off assembly 207 to control the position of the internal pistons and associated compensator rods 188. The tank assembly includes lines 250, control panel 252, valves 254, pipes 255, valves 256, valves 257, valves 258, tanks 260, lines to control panel 262, and manifold 266. Tank assembly 249 is connected to the safety shut off assembly 207 through lines 250. Lines 250 may be fluidly connected to valve inlets 212 of valves 208 on one end and to valves 254 on the other end. In one embodiment, lines 250 are stainless steel braided hose.

Valves 254 are connected to lines 250 on one end and line 262 on the other. Line 262 is connected to valves 254, valves 256, and control panel 262. Valves 256 connect to valves 257, which connect to lines 255. Lines 255 are connected to valves 257 on one end and valves 258 on the other. Valves 258 are connected to manifold 266. The one or more inlets of manifold 266 are fluidly connected to tanks 260. The outlets of manifold 266 are fluidly connected to valves 258. Control panel 252 allows a user to control the flow of the pressurized fluid into the lower chambers of the cylinders 186, which determines the position of compensator rods 188 between the fully extended position and the fully retracted position. Additionally, the control panel 252 alerts when a cylinder has failed. When a cylinder fails, the appropriate valves 254, 256, 257, and/or 258, which are all located on the deck, may be closed off by an operator. Tanks 260 may contain a pressurized gas or liquid that can control the pressure in lower chambers of cylinders 186, thereby controlling the positioning of compensator rods 188 and the extension or retraction of the compensator system 10. In one embodiment, the tanks 260 contain nitrogen gas.

Figure 6:
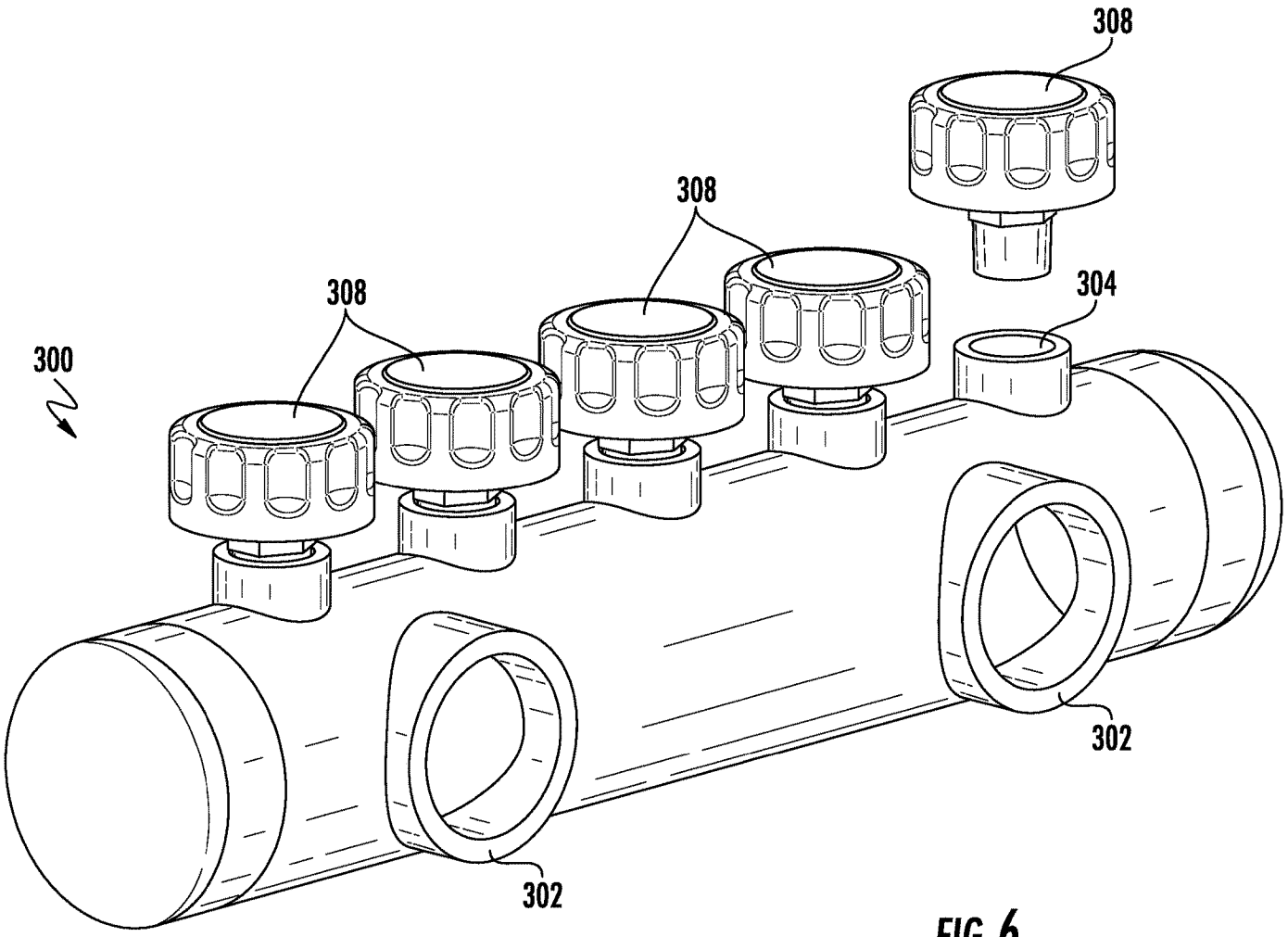
FIG. 6 is a perspective detail view of a filter manifold of the compensator system.

Referring to FIG. 6, the compensator system 10 also includes one or more filter manifolds 300 fluidly connected to the top plate apertures 198 of cylinders 186. Each filter manifold 300 includes inlets 302, outlets 304, and filter caps 308. The inlets 302 are fluidly connected to the top plate apertures 198 of cylinders 186. The outlets 304 vent to the atmosphere. Filter caps 308 are disposed within outlets 304 and prevent the outlets 304 from getting clogged. As shown in FIG. 3, the filter manifolds 300 are connected to top plate apertures 198 via pipe 310 and adapter 312.

Figure 7:
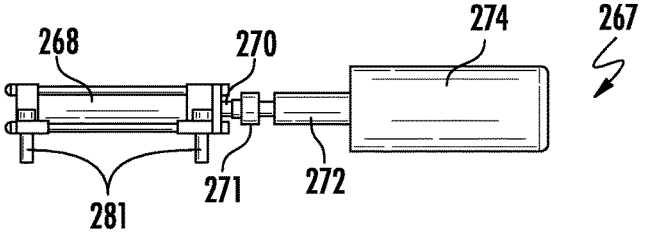
FIG. 7 is a front view of a lock assembly of the compensator system.
Figure 8:
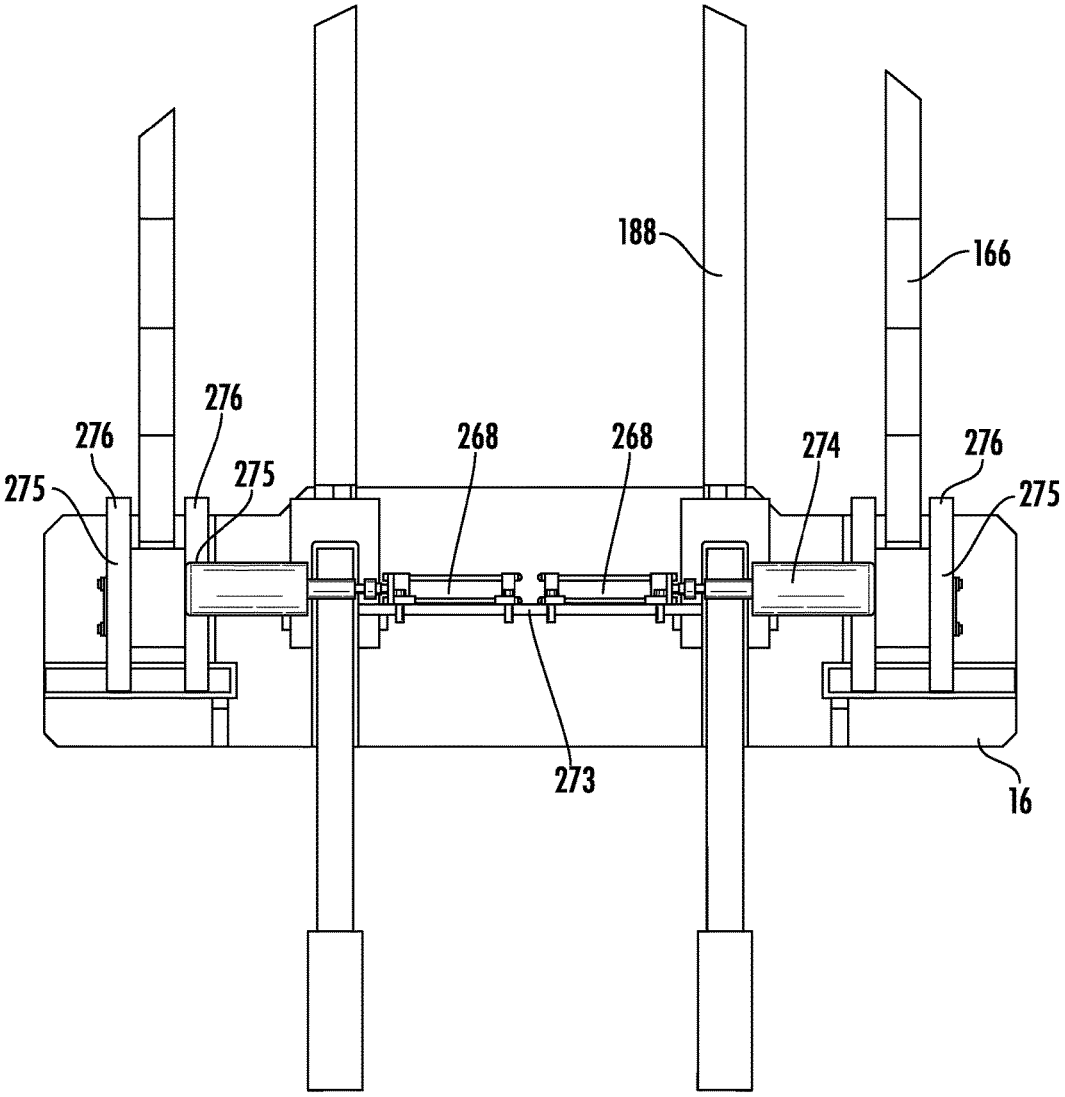
FIG. 8 is a front cutaway view of the lower compensator carriage with the locking assembly in an unlocked position.

With reference to FIGS. 7 and 8, lock assemblies 267 are attached within lower compensator carriage 16. When engaged, lock assemblies 267 retain compensator system 10 in the fully retracted position shown in FIG. 2. Lock assemblies 267 may be operated with a gas, such as nitrogen. Each lock assembly 267 includes lock housing 268, locking pin 270, enlarged diameter portion 271 of locking pin 270, locking plug 274, and reduced diameter portion 272 of locking plug 274. Lock housing 268 is mounted to brace 273 of lower compensator carriage 16 with fasteners 281. In one embodiment, fasteners 281 are bolts, pins, or screws. Lock housing 268 includes a bore, with an aperture located at one end. Lock housing 268 is mounted to brace 273 such that the aperture is directed away from the center of the lower compensator carriage 16. Locking pin 270 includes an enlarged diameter portion 271 that is dimensioned such that it has a larger diameter than the aperture of lock housing 268. The enlarged diameter portion 271 of locking pin 270 is connected to the reduced diameter portion 272 of locking plug 274. Both enlarged diameter portion 271 of locking pin 270 and reduced diameter portion 272 of locking plug 274 are dimensioned so they can move through locking pin aperture 154 of the mounting bracket 106 of the lower compensator carriage 16. Locking plug 274 is dimensioned to be received in apertures 275 in brackets 276 of the lower compensator carriage 16 and aperture 173 of the bracket 167 of the outer guide cylinder assembly 18. The locking pin 270 is capable of being extended or retracted in lock housing 268. When locking pin 270 is in a fully retracted position in lock housing 268 (shown in FIG. 7), the compensator system 10 is in an unlocked position and the guide rods 166 of the outer guide cylinder assembly 18 are able to slide relative to cylinders 162. In the unlocked position, the locking plug 274 is not positioned in aperture 173 of bracket 167 of the outer guide cylinder assembly 18 or in apertures 275 of outermost brackets 276 of the lower compensator carriage 16 (as shown in FIG. 8).

Figure 9:
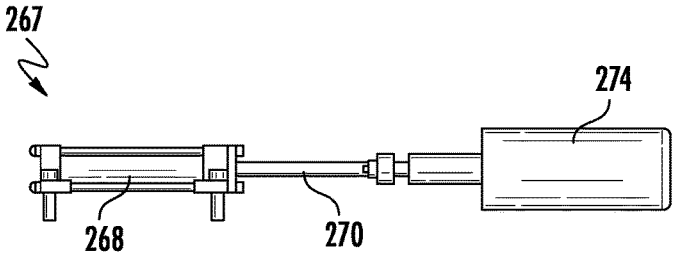
FIG. 9 is a front view of the lock assembly in a locked position.
Figure 10:
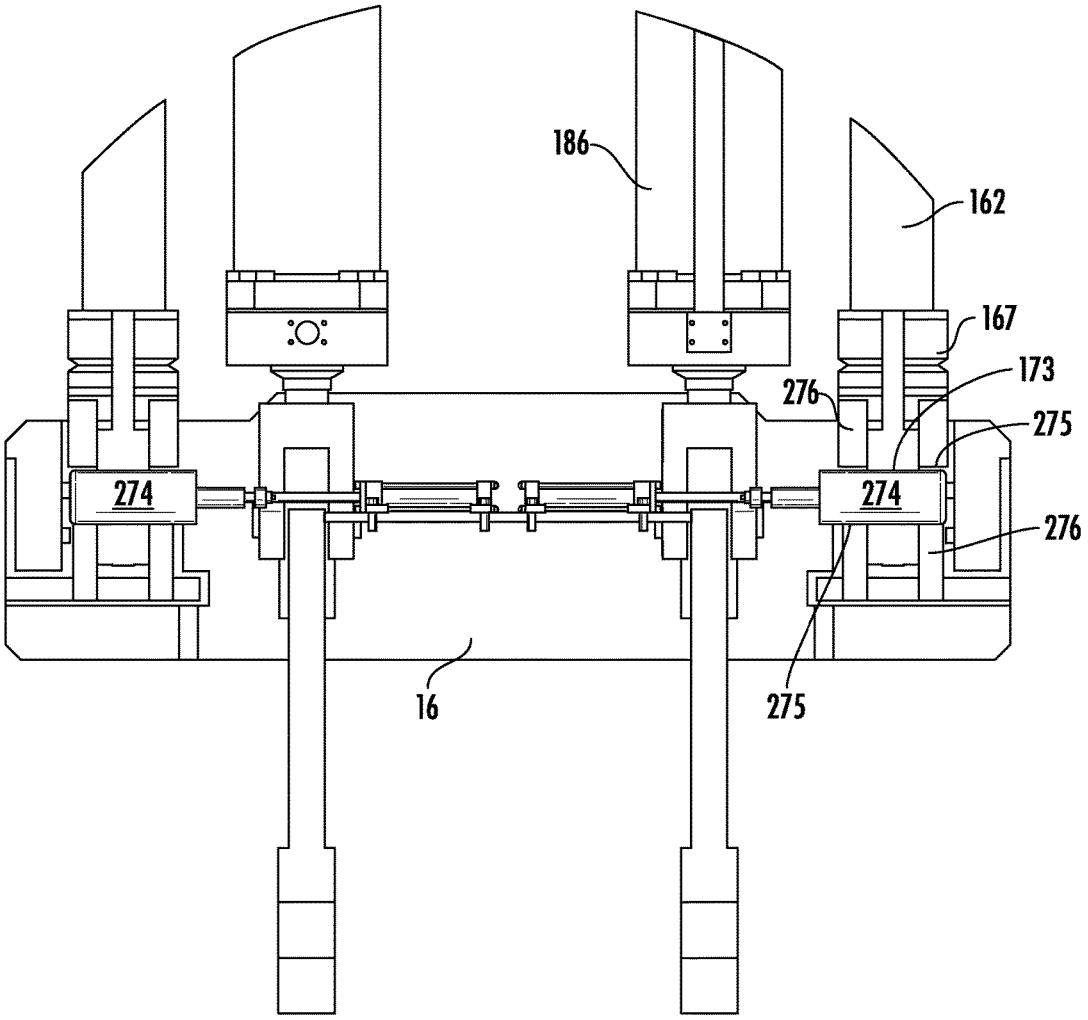
FIG. 10 is a front cutaway view of the lower compensator carriage with the locking assembly in the locked position.

Referring now to FIGS. 9 and 10, locking pin 270 may slide out of lock housing 268 in a locked position. In the locked position, locking plug 274 is disposed through apertures 275 of brackets 276 of the lower compensator carriage 16 and through aperture 173 of bracket 167 of the outer guide cylinder assembly 18. Because locking plug 274 engages aperture 173, the outer guide cylinder assembly 18 is not capable of movement in the locked position. Instead, outer guide cylinder assembly 18, and in turn inner compensator cylinder assembly 20, is locked in the fully retracted position shown in FIG. 2. FIGS. 7 and 8 show the lock assemblies 267 and compensator system 10 in the unlocked position, while FIGS. 9 and 10 show the lock assemblies 267 and compensator system 10 in the locked position.

Figure 11A:
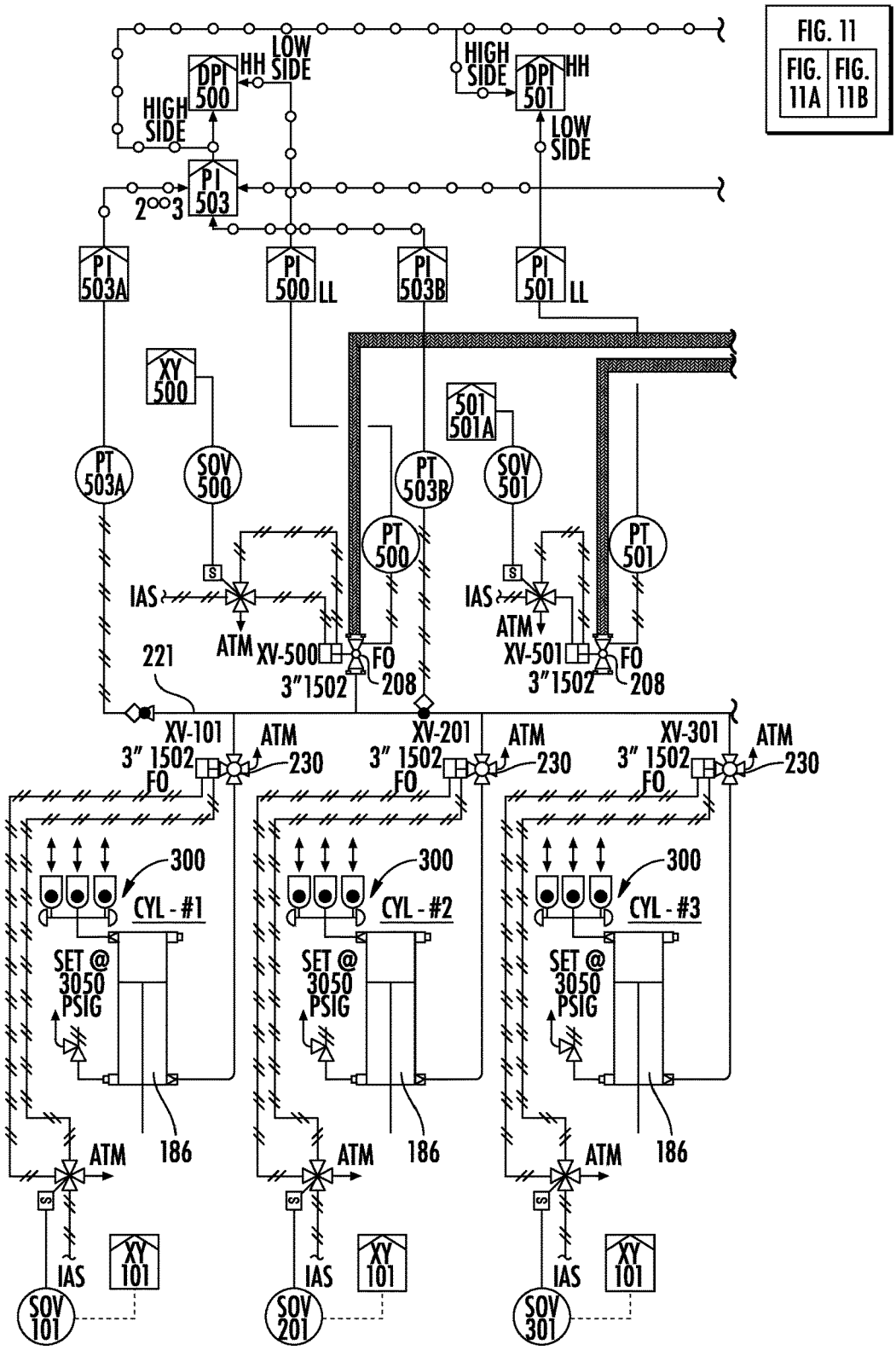
FIGS. 11A and 11B are schematic views of the safety shutoff system.
Figure 11B:
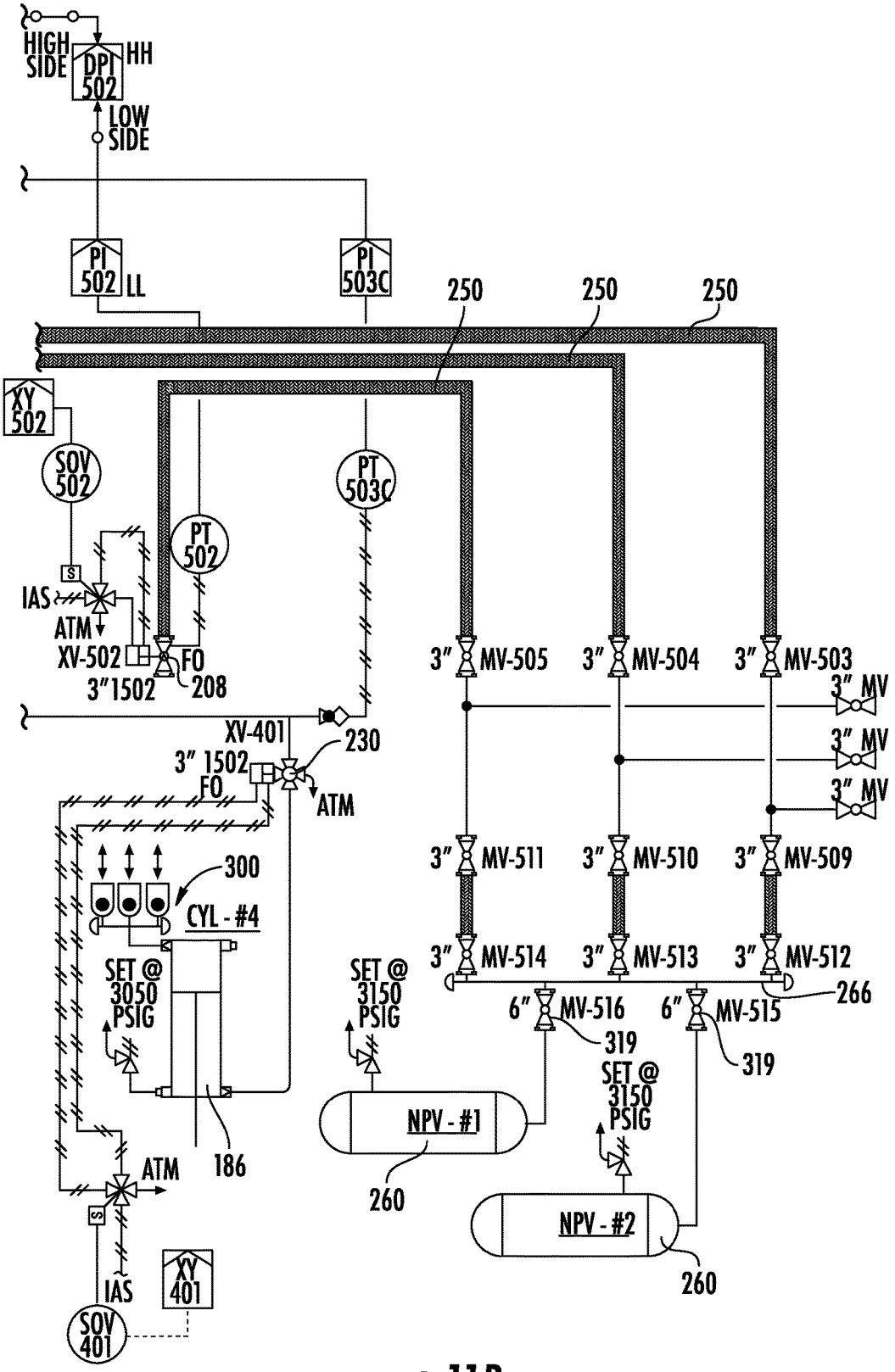

FIGS. 11A and 11B illustrate the flow of fluid within compensator system 10. A pressurized fluid is stored in tanks 260. Tanks 260 are fluidly connected to each of the compensator cylinders 186 through manifold 266, lines 250, valves 208, compensator manifold 221, and compensator valves 230. Each compensator cylinder 186 is fluidly connected to a filter manifold 300. In one embodiment, a tank valve 319 is positioned on each fluid line leading from tank 260 to manifold 266. In operation, only a single tank valve 319 is opened at a time. In other words, one tank 260 provides sufficient flow of the pressurized fluid to contract the compensator system 10; the second tank 260 is a secondary tank that may be filled with the pressurized fluid while the first tank 260 is feeding the cylinders 186.

Figure 12:
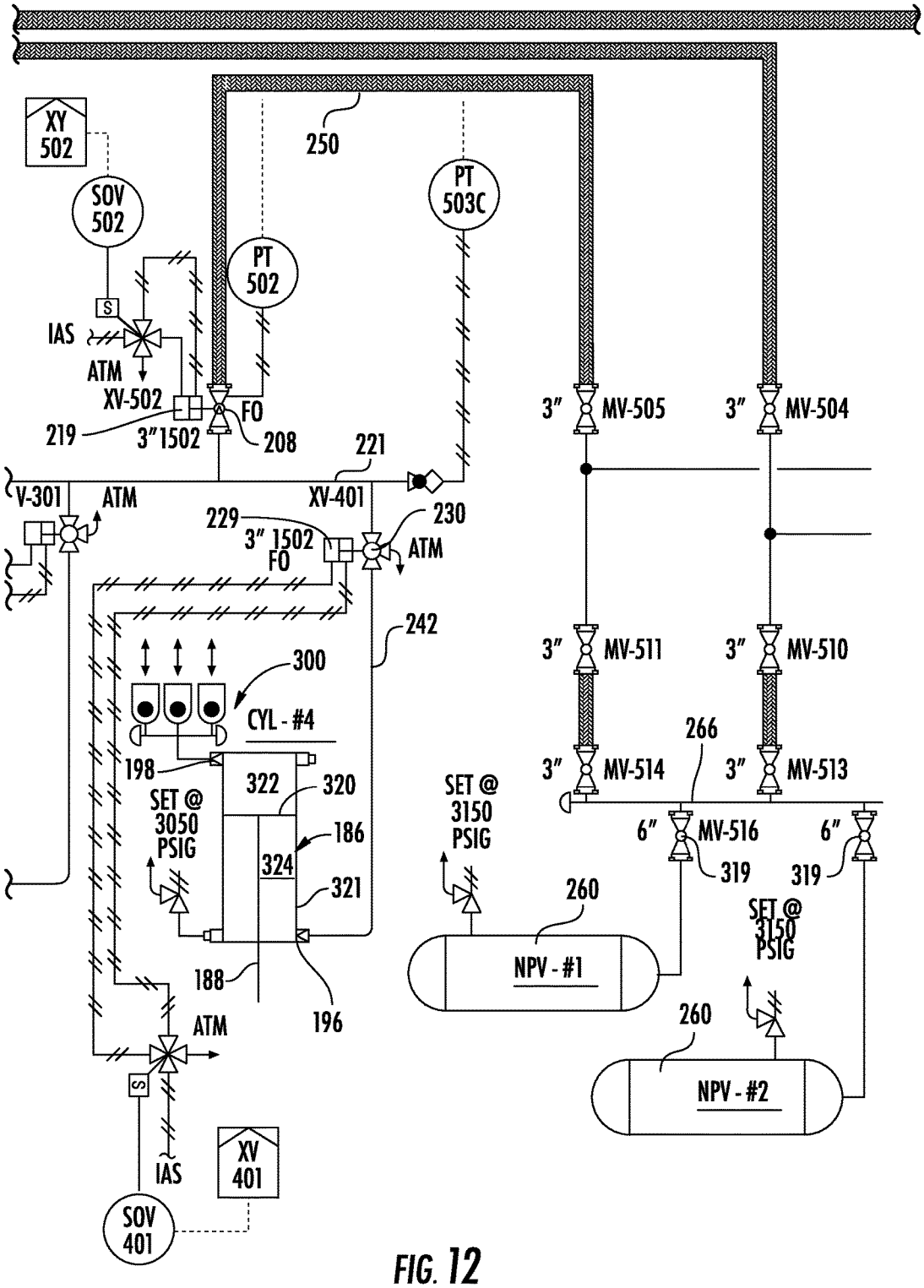
FIG. 12 is a detail schematic view of one compensator cylinder in the safety shutoff system.

Referring to FIG. 12, each compensator cylinder 186 includes piston 320 secured to the upper end of compensator rod 188. Piston 320 is housed within cylinder body 321 of cylinder 186 to define upper chamber 322 and lower chamber 324. To retract compensator system 10, one of the tank valves 319 is opened and actuators 229 and 219 set valves 230 and 208 to allow a pressurized fluid to flow from tanks 260 through manifold 266, lines 250, valves 208, compensator manifold 221, compensator valves 230, pipe 242, bottom plate aperture 196, and into lower chamber 324 of compensator cylinder 186. Specifically, compensator valve 230 may be placed in a feed setting in which a fluid port leading to compensator manifold 221 is open, a fluid port leading to lower chamber 324 is open, and a fluid port leading to the atmosphere is closed. This increases the pressure within lower chamber 324, and in response, piston 320 moves upward. As piston 320 moves upward, any fluid within upper chamber 322 (e.g., air, another gas, or liquid) is vented through top plate aperture 198 and filter manifold 300 to the atmosphere. To expand compensator system 10, actuators 229 set compensator valves 230 to a vent setting in which the fluid port leading to compensator manifold 221 is closed, the fluid port leading to lower chamber 324 is open, and the fluid port leading to the atmosphere is open. In this way, the fluid within lower chamber 324 of compensator cylinder 186 is vented to the atmosphere as piston 320 moves downward within cylinder 186 in response to gravitational forces imposed by a tool suspended from compensator system 10. When piston 320 moves downward, a vacuum is created within upper chamber 322, which pulls air from the atmosphere through filter manifold 300 and through top plate aperture 198 into upper chamber 322.

Compensator system 10 may detect a failure of one of the compensator cylinders 186. In one embodiment, a pressure sensor is in fluid communication with each lower chamber 324. If a pressure reading from any of the lower chambers 324 is below a threshold value (e.g., below 1,500 psi, below 1,000 psi, below 500 psi, below 250 psi, or any subrange therein) with the associated compensator valve 230 in the feed setting, the associated compensator cylinder 186 is a failed compensator cylinder.

In response to a detected failure, the failed compensator cylinder 186 may be isolated by adjusting the compensator valve 230 associated with that cylinder. The adjustment to the compensator valve 230 may involve placing the valve in the vent setting (i.e., closing the fluid port leading to compensator manifold 221 and opening both the fluid port leading to the atmosphere and the fluid port leading to the lower chamber 324 of cylinder 186). The compensator valve 230 may be adjusted manually by a user, or by actuator 229 in response to a manual command from a user or in response to an automated command. With the compensator valves 230 of the other compensator cylinders 186 operating normally, compensator system 10 may continue to expand and retract in response to changes in the distance between the sea floor and a floating vessel on which it rests. The failed compensator cylinder 186 may remain isolated until a time convenient for repair work.

Figure 13:
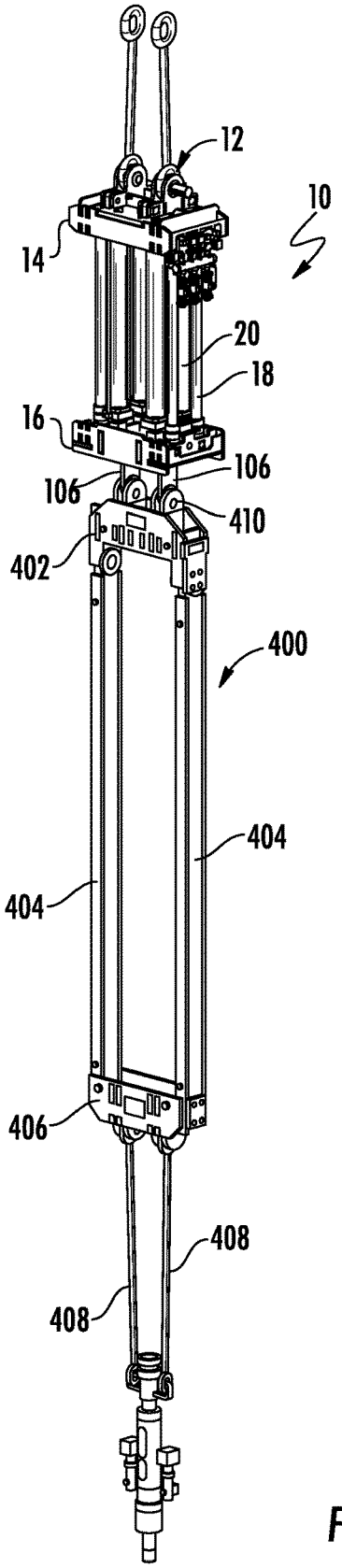
FIG. 13 is a perspective view of a coil tubing lift frame attached to the compensator system.
Figure 14:
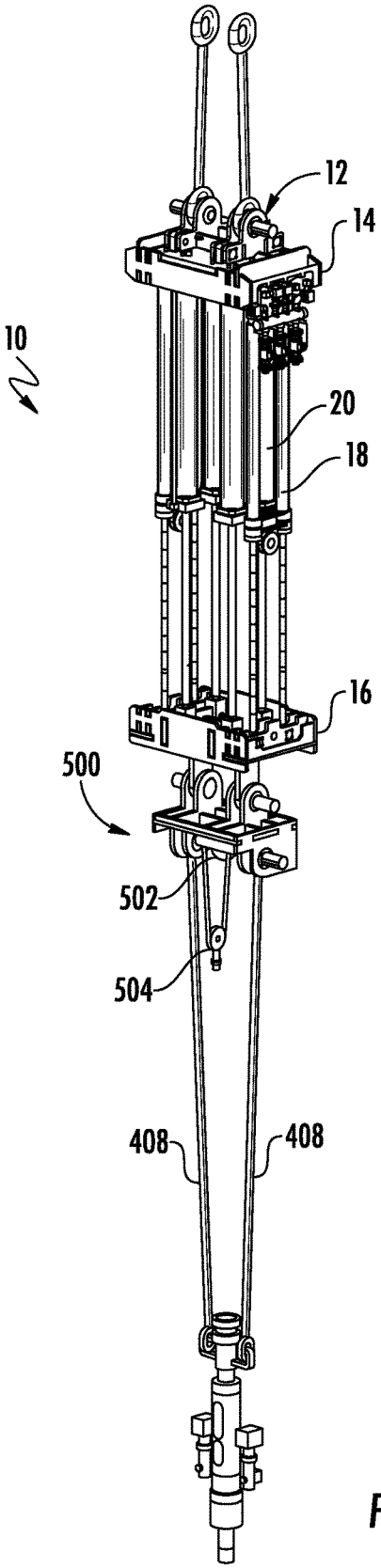
FIG. 14 is a perspective view of a winching frame attached to the compensator system.

Compensator system 10 may be used with coil tubing as shown in FIG. 13 or with winching frames, wire line, or e-line setups as shown in FIG. 14.

With reference to FIG. 13, for use with coil tubing applications, the lower compensator carriage 16 is connected to the coil tubing lift frame 400. Coil tubing lift frame 400 includes upper portion 402, spaced apart arms 404, and bottom portion 406. The upper portion 402 has spaced apart arms 404 located on each side of the upper portion 402. Spaced apart arms 404 are connected to the upper portion 402 of the coil tubing lift frame 400 at their upper end. Spaced apart arms 404 are connected to each side of the bottom portion 406 at their lower ends. Bails 408 may be connected to the bottom portion 406 of coil tubing lift frame 400. The upper portion 402 of coil tubing lift frame 400 includes mounting brackets 410, which may be secured to mounting brackets 106 of the lower compensator carriage 16. For example, fasteners may be secured through mounting apertures 108 of mounting brackets 106 in lower compensator carriage 16 and through apertures in mounting brackets 410 of coil tubing lift frame 400.

FIG. 14 illustrates compensator system 10 connected to winching frame 500. Winching frame 500 has a winch 502 connected to its bottom side. Fastener 504 is suspended from winch 502. In one embodiment, fastener 504 is a shackle. Winching frame 500 may also have bails 408 connected thereto.

Figure 15:
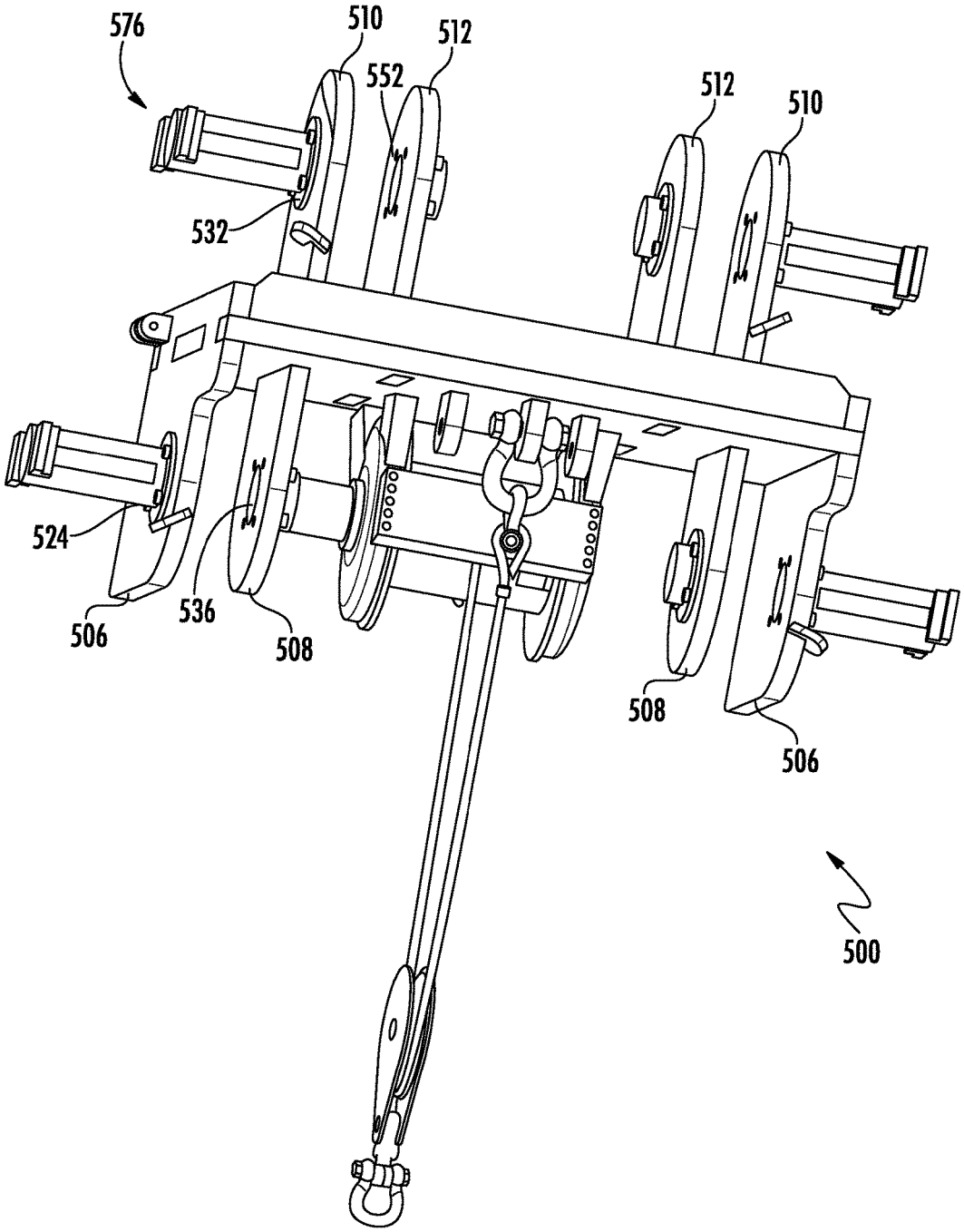
FIG. 15 is a perspective view of the winching frame.

With reference to FIG. 15, winching frame 500 may include lower mounting brackets 506 and 508 and upper mounting brackets 510 and 512. Lower mounting brackets 506 and 508 include apertures 524 and 536, respectively. Apertures 524 and 536 are used to receive a fastener for securing bails 408 to winching frame 500. Upper mounting brackets 510 and 512 include apertures 532 and 552, respectively. Apertures 532 and 552 are used to receive a fastener for securing winching frame 500 to lower compensator carriage 16.

Figure 16:
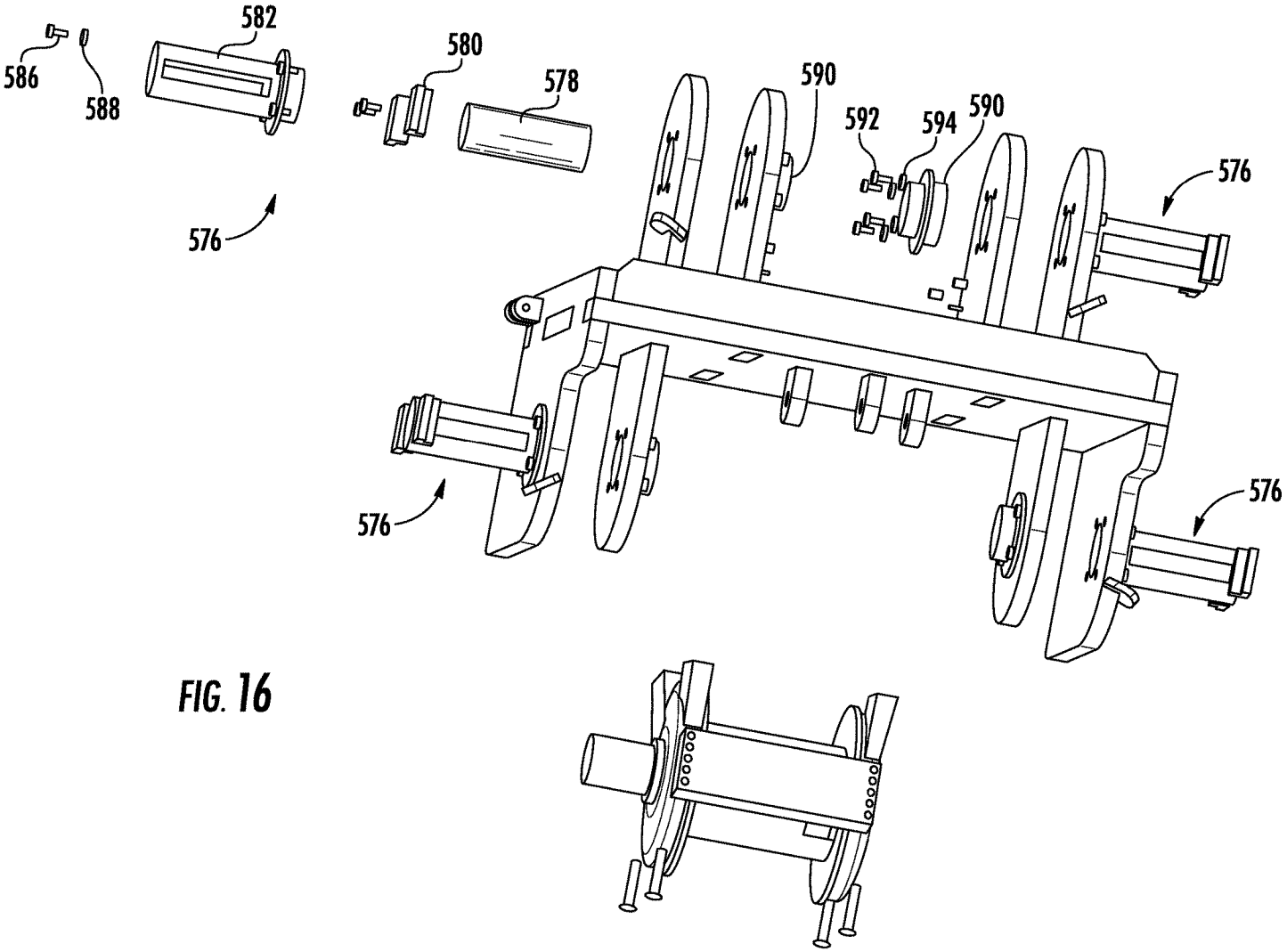
FIG. 16 is a partially-exploded view of the winching frame showing the components of a fastener assembly.

With reference to FIG. 16, fastener assemblies 576 are secured in apertures 532 and 552 to connect the winching frame 500 to the lower compensator carriage 16 and secured in apertures 524 and 536 to connect the bails 408 to the winching frame 500. Each fastener assembly 576 is a locking system that requires two or more aligned apertures to function properly. Fastener assembly 576 includes pin 578, slide 580, pin bracket 582, fasteners 586 (such as screws or bolts) to mount the pin bracket 582 to a first bracket surrounding a first aperture, washers 588 to be used with fasteners 586, flange 590 positioned about a second aperture in a second bracket, fasteners 592 (such as screws or bolts) to mount the flange 590 about the second aperture, and washers 594 to be used with fasteners 592.

Pin bracket 582 includes slots located along the length of the pin bracket 582 but the slots do not extend to the ends of pin bracket 582. Pin bracket 582 is a hollow cylinder with one enclosed end. Pin bracket 582 includes a flange that extends around its open end. Slide 580 is located within the slots of pin bracket 582 and is configured to slide along the slots. Slide 580 has ends that are larger than its central portion, which is retained in the slots of the pin bracket 582. The ends of slide 580 are larger than the slots in pin bracket 582, which retains the slide in pin bracket 582. Pin 578 is placed in pin bracket 582 so that the pin 578 is positioned between the slide 580 and the open end of pin bracket 582. In one embodiment, slide 580 is secured to the end of pin 578, such as with a fastener, bolt, or screw. Pin bracket 582 is connected to the upper mounting bracket 510 of the winching frame 500. To connect pin bracket 582 to the upper mounting bracket 510, washers 588 are placed on fasteners 586. Fasteners 586 are then secured in apertures in the flange of pin bracket 582 and secured in apertures surrounding aperture 532 of upper mounting bracket 510. Flange 590 is placed about aperture 552 on the opposite side of upper mounting bracket 512. Washers 594 are placed on fasteners 592. Fasteners 592 are then placed through apertures in flange 590 and secured in apertures surrounding aperture 552 of upper mounting bracket 512. To engage the fastening assembly 576, the slide 580 is moved inward to insert pin 578 through aperture 532 of the upper mounting bracket 510 and into aperture 552 of upper mounting bracket 512.

Figure 17:
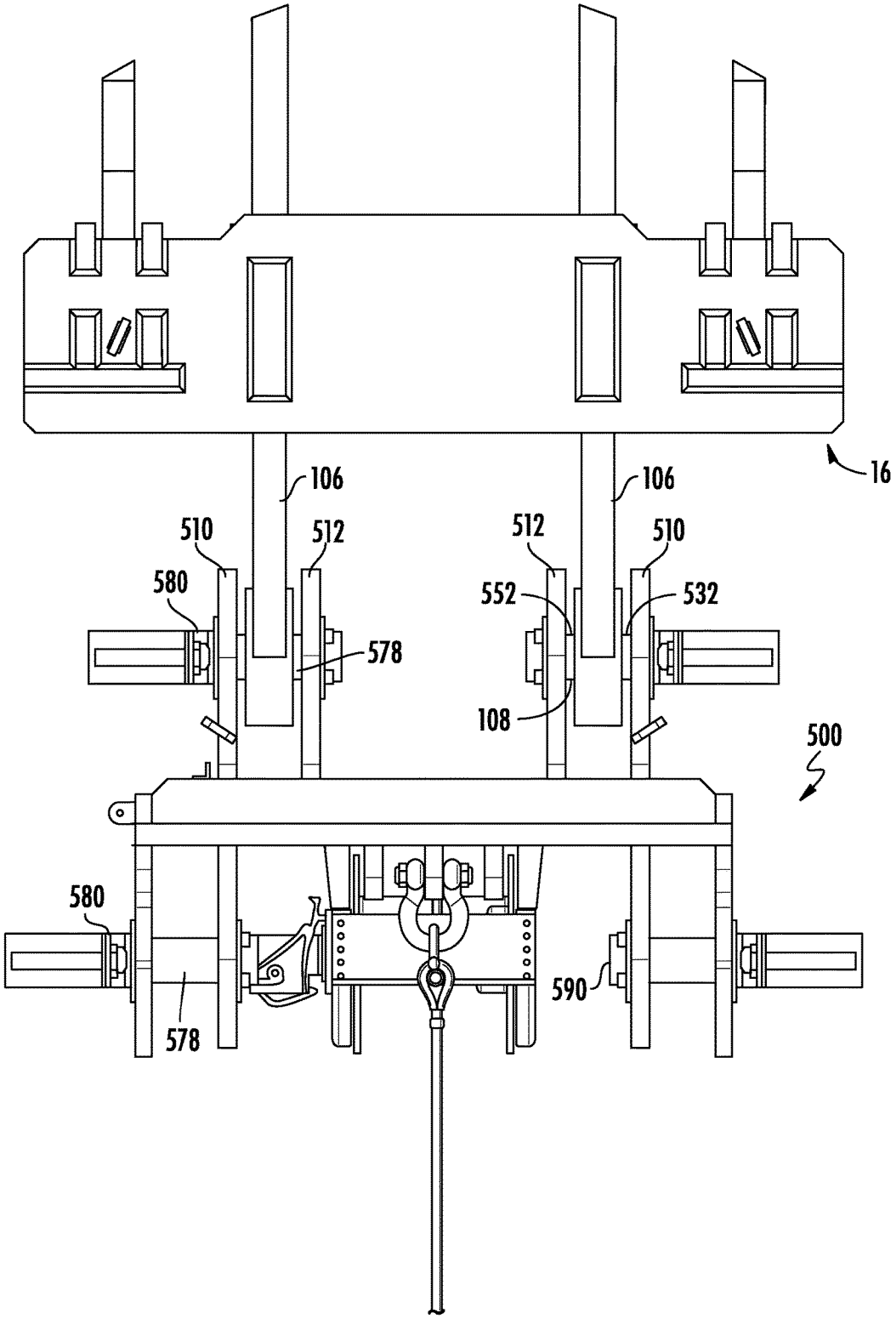
FIG. 17 is a front detail view of the winching frame attached to the lower carriage assembly.

As shown in FIG. 17, winching frame 500 is secured to the lower compensator carriage 16 using fastener assemblies 576. Mounting brackets 106 of lower compensator carriage 16 are positioned between the pairs of upper mounting brackets 510 and 512 of winching frame 500 such that mounting apertures 108 of lower compensator carriage 16 are aligned with apertures 532 and 552 of upper mounting brackets 510 and 512 of winching frame 500, respectively. Slides 580 of each fastener assembly 576 are then transferred in an inward direction toward upper mounting brackets 510. Pins 578 slide through apertures 532, 108, and 552, thereby securing winching frame 500 to lower compensator carriage 16. To remove the winching frame 500 from the lower compensator carriage 16, the slides 580 are moved in the opposite direction away from upper mounting brackets 510, thereby sliding pins 578 out of apertures 532, 108, and 552 and back into the pin brackets 582.

While the installation and use of fastener assembly 576 is described herein in reference to winching frame 500, fastener assembly 576 may be used in any application in which a lift eye is secured between two braces with apertures of the lift eye and each brace aligned. Fastener assemblies 576 remain secured to and aligned with the associated aperture in a locked position and in an unlocked position. This provides safety advantages over conventional fasteners, which involve loose components that may fall and result in injury to workers.

For example, fastener assemblies 576 may be secured in central aperture 25 of lift eyes 22 in the upper compensator carriage 12 for suspending compensator system 10 from a crane or derrick (shown generally in FIGS. 1-3). Upper compensator carriage 12 and fastener assemblies 576 allow compensator assembly 10 to be connected directly to the crown block without the need for elevators. This arrangement reduces the height of the compensator system 10 over conventional systems.

While the illustrative forms disclosed herein have been described with particularity, it will be understood that various other modifications will be apparent to and can be readily made by those skilled in the art without departing from the spirit and scope of the disclosure. Accordingly, it is not intended that the scope of the claims appended hereto be limited to the example and descriptions set forth herein, but rather that the claims be construed as encompassing all the features of patentable novelty which reside herein, including all features which would be treated as equivalents thereof by those skilled in the art to which this disclosure pertains.

We claim:

1. A motion compensator system for use on a floating vessel, comprising:

a compensator cylinder assembly including three or more compensator cylinders each including a compensator cylinder body, a compensator piston slidingly disposed within the compensator cylinder body to define an upper chamber and a lower chamber, and a compensator rod slidingly disposed within the lower chamber with an upper end affixed to the compensator piston and a lower end extending beyond the compensator cylinder body;

a guide cylinder assembly including three or more guide cylinders, wherein each guide cylinder includes a guide cylinder body and a guide rod slidingly disposed within the guide cylinder body, wherein a lower end of the guide rod extends beyond the guide cylinder body;

an upper carriage affixed to an upper end of each compensator cylinder body and an upper end of each guide cylinder body;

a lower carriage affixed to the lower end of each compensator rod and the lower end of each guide rod; and a safety shutoff assembly including a compensator manifold and three or more compensator valves, wherein each compensator valve is in fluid communication with a pressurized fluid source through the compensator manifold and in fluid communication with the lower chamber of one of the compensator cylinder bodies, wherein the safety shutoff assembly is configured to isolate a failed compensator cylinder by setting the compensator valve in fluid communication therewith to a vent setting.

2. The motion compensator system of claim 1, wherein the safety shutoff assembly further comprises three or more valve actuators each configured to adjust a setting of one of the compensator valves in response to a signal from a control unit.

3. The motion compensator system of claim 2, wherein each compensator valve is a three way valve; and wherein the vent setting of the compensator valve closes a fluid port leading to the compensator manifold, opens a fluid port leading to an atmospheric vent, and opens a fluid port leading to the lower chamber of the compensator cylinder body to allow fluid flow between the lower chamber and the atmosphere.

4. The motion compensator system of claim 1, further comprising a guide bracket secured to a lower end of two guide cylinder bodies, wherein the guide bracket includes a lock aperture.

5. The motion compensator system of claim 4, further comprising a lock assembly secured to the lower carriage, the lock assembly including a lock plug dimensioned for selectively engaging the lock aperture of the guide bracket to secure the motion compensator system in a retracted position.

6. The motion compensator system of claim 5, wherein the lower carriage includes two spaced-apart carriage brackets each including a carriage aperture, wherein the guide bracket is partially disposed between the carriage brackets in the retracted position to align the carriage apertures with the lock aperture, and wherein the lock plug further selectively engages the carriage apertures in the retracted position.

7. The motion compensator system of claim 1, wherein the compensator cylinder assembly includes four compensator cylinders, and wherein the guide cylinder assembly includes four guide cylinders.

8. The motion compensator system of claim 7, further comprising a first guide bracket secured to a lower end of two guide cylinder bodies and a second guide bracket secured to a lower end of the other two guide cylinder bodies, wherein the first guide bracket and the second guide bracket each includes a lock aperture.

9. The motion compensator system of claim 8, further comprising a first lock assembly and a second lock assembly secured to the lower carriage, the first lock assembly including a first lock plug dimensioned for selectively engaging the lock aperture of the first guide bracket and the second lock assembly including a second lock plug dimensioned for selectively engaging the lock aperture of the second guide bracket to secure the motion compensator system in a retracted position.

10. The motion compensator system of claim 1, further comprising a filter manifold in fluid communication with the upper chamber of one or more of the compensator cylinder bodies, wherein the filter manifold includes a filtered outlet to the atmosphere for venting a fluid from the upper chamber of the compensator cylinder body during retraction of the motion compensator system and for providing air flow from the atmosphere into the upper chamber of the compensator cylinder body during extension of the motion compensator system.

11. A motion compensator system for use on a floating vessel, comprising:

a compensator cylinder assembly including three or more compensator cylinders each including a compensator cylinder body, a compensator piston slidingly disposed within the compensator cylinder body to define an upper chamber and a lower chamber, and a compensator rod slidingly disposed within the lower chamber with an upper end affixed to the compensator piston and a lower end extending beyond the compensator cylinder body;

a guide cylinder assembly including three or more guide cylinders, wherein each guide cylinder includes a guide cylinder body and a guide rod slidingly disposed within the guide cylinder body, wherein a lower end of the guide rod extends beyond the guide cylinder body;

an upper carriage affixed to an upper end of each compensator cylinder body and an upper end of each guide cylinder body, wherein the upper carriage includes two or more lift eyes each having a central aperture;

a fastener assembly secured to one of the lift eyes and aligned with the central aperture, the fastener assembly including a pin bracket, a pin slidingly disposed within the pin bracket, a slide disposed within the pin bracket and secured to an inner end of the pin, wherein the pin is dimensioned to slide through the central apertures of the lift eyes, and wherein an outer end of the slide is disposed through a longitudinal slot in the pin bracket for controlling the position of the pin relative to the central apertures of the lift eyes;

a lower carriage affixed to the lower end of each compensator rod and the lower end of each guide rod; and a safety shutoff assembly including a compensator manifold and three or more compensator valves, wherein each compensator valve is in fluid communication with a pressurized fluid source through the compensator manifold and in fluid communication with the lower chamber of one of the compensator cylinder bodies, wherein the safety shutoff assembly is configured to isolate a failed compensator cylinder by setting the compensator valve in fluid communication therewith to a vent setting.

12. The motion compensator system of claim 11, wherein the safety shutoff assembly further comprises three or more valve actuators each configured to adjust a setting of one of the compensator valves in response to a signal from a control unit.

13. The motion compensator system of claim 12, wherein each compensator valve is a three way valve; and wherein the vent setting of the compensator valve closes a fluid port leading to the compensator manifold, opens a fluid port leading to an atmospheric vent, and opens a fluid port leading to the lower chamber of the lower chamber of the compensator cylinder body to allow fluid flow between the lower chamber and the atmosphere.

14. The motion compensator system of claim 11, further comprising a guide bracket secured to a lower end of two guide cylinder bodies, wherein the guide bracket includes a lock aperture.

15. The motion compensator system of claim 14, further comprising a lock assembly secured to the lower carriage, the lock assembly including a lock plug dimensioned for selectively engaging the lock aperture of the guide bracket to secure the motion compensator system in a retracted position.

16. A method of compensating for motion on a floating vessel, comprising the steps of:

a) providing a motion compensator system comprising: a compensator cylinder assembly including three or more compensator cylinders each including a compensator cylinder body, a compensator piston slidingly disposed within the compensator cylinder body to define an upper chamber and a lower chamber, and a compensator rod slidingly disposed within the lower chamber with an upper end affixed to the compensator piston and a lower end extending beyond the compensator cylinder body; a guide cylinder assembly including three or more guide cylinders, wherein each guide cylinder includes a guide cylinder body and a guide rod slidingly disposed within the guide cylinder body, wherein a lower end of the guide rod extends beyond the guide cylinder body; an upper carriage affixed to an upper end of each compensator cylinder body and an upper end of each guide cylinder body; a lower carriage affixed to the lower end of each compensator rod and the lower end of each guide rod; and a safety shutoff assembly including a compensator manifold and three or more compensator valves, wherein each compensator valve is in fluid communication with a pressurized fluid source through the compensator manifold and in fluid communication with the lower chamber of one of the compensator cylinder bodies;

b) suspending the motion compensator system from a suspension device on a floating vessel;

c) securing a well tool to the lower carriage to suspend the well tool below the motion compensator system;

d) when a distance between the floating vessel and a sea floor decreases, retracting the motion compensator system by setting the compensator valves to a feed setting to allow a fluid to flow from the pressurized fluid source into the lower chamber of each of the compensator cylinder bodies, thereby lifting the compensator piston, the compensator rod, the lower carriage, and the well tool relative to the upper carriage;

e) when the distance between the floating vessel and the sea floor increases, extending the motion compensator system by setting the compensator valves to a vent setting in which the fluid in the lower chambers is vented to the atmosphere through a vent outlet of each of the compensator valves, thereby lowering the compensator piston, the compensator rod, the lower carriage, and the well tool relative to the upper carriage;

f) monitoring a pressure within the lower chamber of each compensator cylinder body to detect a failure of the compensator cylinder body.

17. The method of claim 16, further comprising the steps of:

g) in response to a detected pressure leak in the lower chamber of a failed compensator cylinder, isolating the failed compensator cylinder by setting the compensator valve in fluid communication with the failed compensator cylinder to the vent setting, wherein after the isolation of the failed compensator cylinder steps (d) and (e) continue for the remaining compensation cylinders.

18. The method of claim 16, wherein in step (a) the motion compensator system further comprises a guide bracket and a lock assembly, wherein the guide bracket is secured to a lower end of two guide cylinder bodies, wherein the guide bracket includes a lock aperture, wherein the lock assembly is secured to the lower carriage, the lock assembly including a lock plug dimensioned for selectively engaging the lock aperture of the guide bracket; wherein the method further includes the step of:

g) locking the motion compensator system in a fully retracted position by setting the lock assembly to a locked position in which the lock plug is disposed through the lock aperture of the guide bracket at the lower end of the guide cylinder bodies.

19. The method of claim 16, wherein in step (a) the upper carriage includes two or more lift eyes each having a central aperture, and wherein the motion compensator system further comprises a fastener assembly secured to one of the lift eyes and aligned with the central aperture, the fastener assembly including a pin bracket, a pin slidingly disposed within the pin bracket, a slide disposed within the pin bracket and secured to an inner end of the pin, wherein an outer end of the slide is disposed through a longitudinal slot in the pin bracket for controlling the position of the pin relative to the central apertures of the lift eyes.

20. The method of claim 19, wherein in step (b) the motion compensator system is suspended from the suspension device by aligning an aperture of a support member of the suspension device with the central apertures of two lift eyes of the motion compensator system, and pushing the outer end of the slide to transfer the pin from the pin bracket through the central apertures of the two lift eyes and through the aperture of the support member of the suspension device.

* * * * *